US006690288B1

(12) United States Patent
Waddell

(10) Patent No.: US 6,690,288 B1
(45) Date of Patent: Feb. 10, 2004

(54) PORTABLE EMERGENCY RESPONSE SYSTEM

(76) Inventor: Debbie Waddell, 458 Farm Branch Dr., Fort Mill, SC (US) 29715

( * ) Notice: Subject to any disclaimer, the term of this patent is extended or adjusted under 35 U.S.C. 154(b) by 0 days.

(21) Appl. No.: 10/316,383

(22) Filed: Dec. 10, 2002

Related U.S. Application Data

(60) Provisional application No. 60/339,763, filed on Dec. 10, 2001.

(51) Int. Cl.[7] ..... G08B 25/08

(52) U.S. Cl. ..... 340/692; 340/628; 340/691.1; 340/693.5; 340/693.9; 340/693.12; 340/539.11; 340/545.7

(58) Field of Search ..... 340/692, 628, 340/691.1, 696.6, 693.5, 693.9, 693.12, 539.11, 539.26, 545.7

(56) References Cited

U.S. PATENT DOCUMENTS

| | | | | |
|---|---|---|---|---|
| 5,594,422 A | | 1/1997 | Huey, Jr. et al. | 340/628 |
| 5,663,714 A | | 9/1997 | Fray | 340/692 |
| 5,731,759 A | | 3/1998 | Finucan | 340/628 |
| 6,043,750 A | | 3/2000 | Mallory | 340/693.8 |
| 6,075,447 A | | 6/2000 | Nightingale et al. | 340/628 |
| 6,121,885 A | | 9/2000 | Masone et al. | 340/628 |
| 6,133,839 A | | 10/2000 | Ellul, Jr. et al. | 340/584 |
| 6,154,130 A | | 11/2000 | Mondejar et al. | 340/521 |
| 6,222,455 B1 | * | 4/2001 | Kaiser | 340/628 |

* cited by examiner

*Primary Examiner*—Donnie L. Crosland
(74) *Attorney, Agent, or Firm*—Steptoe & Johnson PLLC

(57) ABSTRACT

An emergency response system including a smoke detector and an evacuation guide. The emergency response system and evacuation guide are separate components removably attached to each other, and each has a shape that includes a long, narrow neck and a curved handle, which permits both the smoke detector and evacuation guide to be installed by hanging each from a door knob. The smoke detector includes, in addition to means for sensing smoke and means for emitting an alarm, a radio transmitter that generates and transmits an activation signal in the form of radio waves. The radio waves are detected by a radio receiver in the evacuation guide. Upon receipt of the activation signal, a digital recording and playback device delivers a message to occupants of the home or building. A flashlight contained within the evacuation guide also is illuminated.

20 Claims, 1 Drawing Sheet

PORTABLE EMERGENCY RESPONSE SYSTEM

This application claims benefit of Provisional Application No. 66/339,763 filed on Dec. 10, 2001.

BACKGROUND OF THE INVENTION

1. Field of Invention

This invention relates to emergency safety devices, and more particularly to a portable smoke detector and guide for helping an occupant evacuate a house or building.

2. Related Art

Smoke detectors are typically mounted in particular rooms of a home, such as bedrooms and hallways, to warn of the presence of smoke generated during the initial stages of a fire and to enable the occupants to evacuate the home safely. Conventional smoke detectors generally emit a high-pitched tone, or alarm signal, to notify occupants that smoke is present and that they should evacuate the home or building. Evacuating the home or building may be complicated, however, by several factors. First, fires often start and generate smoke during the night when the house is dark, thereby making evacuation more difficult. Second, being awakened from a deep sleep by a high-pitched smoke alarm may disorient the occupants, especially if they include young children or elderly persons.

In an attempt to overcome these complications, smoke detectors, also called smoke alarm warning systems, sometimes include a built-in light source to provide emergency illumination. Such devices typically are employed in hallways and exit areas of a building and are beneficial when a building loses its electricity as a result of fire. These devices often include a high intensity flashing strobe light that is visible through intense smoke, thereby helping occupants evacuate the burning building by identifying the location of an exit. Smoke alarm warning systems also may include a standard smoke detector mountable in a normal location on the ceiling of a room and a separate light indicator that can be mounted in a location remote from the smoke detector. These light indicators often include a light as well as a microphone for receiving the audible alarm signals generated by the smoke detector. The light indicator often has a flashing light housing that is designed to be mounted on a window for visibility outside the building, thereby identifying the room where smoke has been detected so that rescuers will know where to go to put out the fire and/or rescue occupants of a burning building or home. These devices often utilize a radio frequency transmitter in the smoke detector and a receiver in the light housing.

While these various smoke alarm warning systems provide a light source at or near an exit or a window in the home or building to be evacuated, they provide no illumination to occupants at or near the location where the occupants are likely to be situated when the alarm goes off, i.e., their bedroom. Also, conventional smoke detectors do nothing to help orient the occupants or assist them in evacuating the dwelling. Therefore, there remains a need for a smoke alarm warning system that includes a portable means of illumination proximally located to the occupants of a burning house or building, as well as a means for giving instruction and guidance to the occupants of a burning home or building to help them exit safely.

U.S. Pat. No. 6,154,130 issued to Mondejar et al. discloses a portable room security system for use in hotel rooms, apartments, and vehicles having sleeping areas. The device in Mondejar et al. includes a smoke detector and circuitry for triggering an additional remote alarm via a telephone link, and a tape player or digital audio means for automatically playing a pre-recorded message announcing the emergency and asking for help when someone at a remote location answers the call. While the device in Mondejar et al. plays a message to a third-party, it does not have an evacuation guide which is separate and distinct from the smoke detector and that delivers a message to the occupant of the house or building to help him or her exit safely. Thus, there remains a need for an emergency response system that communicates a calming message to occupants, and that also assists them in evacuating a burning building.

U.S. Pat. No. 5,663,714 issued to Fray discloses an alarm system including a smoke detector that emits (1) high-pitched alarm signals to warn of smoke and (2) voice messages. The system disclosed in Fray does not include a self-contained evacuation guide which is separate and distinct from the smoke detector. Instead, Fray teaches a smoke detector capable of delivering messages in different forms, such as high-pitch pulses and verbal messages. Fray does not teach a self-contained evacuation guide positioned away from a smoke detector, and including a personal light source and a means for delivering a message to occupants. As a result, there remains a need for an emergency response system that has an evacuation guide which is activated by a smoke detector, and that provides to occupants a source of light to see their immediate surroundings and a source for receiving messages about how best to exit the room and/or building or home.

SUMMARY OF THE INVENTION

The present invention solves the problems encountered with prior smoke alarm warning systems by providing a portable smoke detector that, in addition to sounding an alarm upon sensing smoke, activates an evacuation guide that helps occupants evacuate a burning building by playing a pre-recorded message.

An aspect of the invention is an emergency response system, including a smoke detector having a front, a back, a shape, a body, a neck contiguous with and extending from the body and ending in a curved handle, and a means for generating an activation signal; and an evacuation guide having a front, a back, a shape, a body, a neck contiguous with and extending from the body and ending in a curved handle, a means for receiving the activation signal, and a means for delivering a message to an occupant of a home or a building, wherein the smoke detector is a self-contained and separate unit from said evacuation guide and is adapted to be used while physically detached from the evacuation guide, and further wherein the evacuation guide is a self-contained and separate unit from the smoke detector and is adapted to be used while physically detached from the smoke detector.

Another aspect of the invention is a method of operating an emergency response system in an environment having a room with a door having an inside door knob and an outside door knob, including the steps of (a) detecting smoke using a smoke detector, wherein the smoke detector has a shape, a body, a neck contiguous with and extending from the body and ending in a curved handle, and a means for generating an activation signal, by hanging the handle of the smoke detector on the outside door knob; (b) generating an activation signal from the smoke detector; (c) receiving the activation signal by an evacuation guide that has a shape, a body, a neck contiguous with and extending from the body and ending in a curved handle, a means for receiving the activation signal, and a means for delivering a message to an occupant of a home or a building; the evacuation guide being hung from the inside door knob by the handle; and (d) delivering a verbal message to the occupant(s) inside the room.

A feature of the invention is a portable smoke detector that can be hung from a door knob.

Another feature of the invention is a portable smoke detector that communicates with an evacuation guide to activate the guide in the event of the presence of smoke.

Another feature of the invention is an evacuation guide that plays a pre-recorded message in response to receiving an activation signal from a smoke detector.

Another feature of the invention is a portable evacuation guide that can be hung from a door knob.

An advantage of the invention is that the portable smoke detector and portable evacuation guide are mirror images of each other such that they can be placed back to back and secured together by latches when not in use.

Another advantage of the invention is the slim-line design of the evacuation guide that facilitates carrying by small hands, i.e. those of young children.

Another advantage of the invention is an evacuation guide that has a flashlight to help an occupant see as he or she evacuates a burning building.

EMBODIMENTS OF THE INVENTION

Figure 1C:
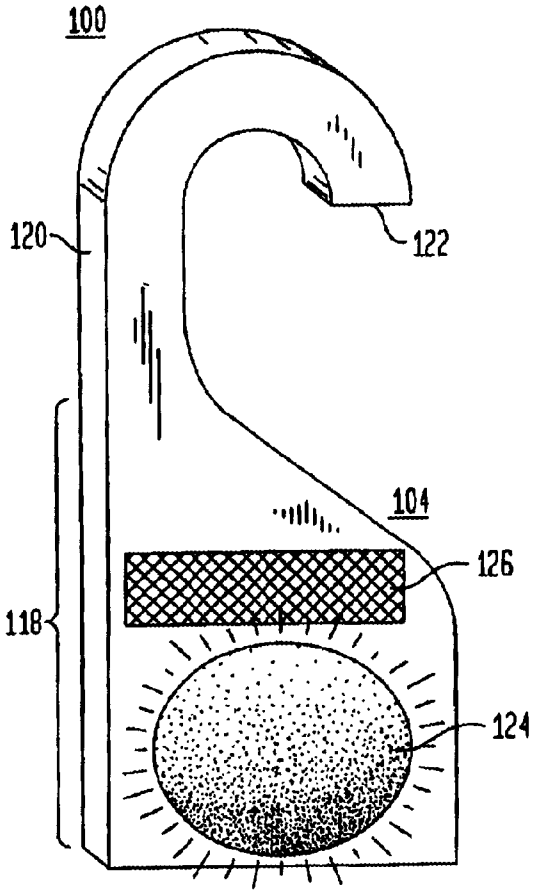
FIG. 1C is a perspective front view of an evacuation guide.
Figure 1B:
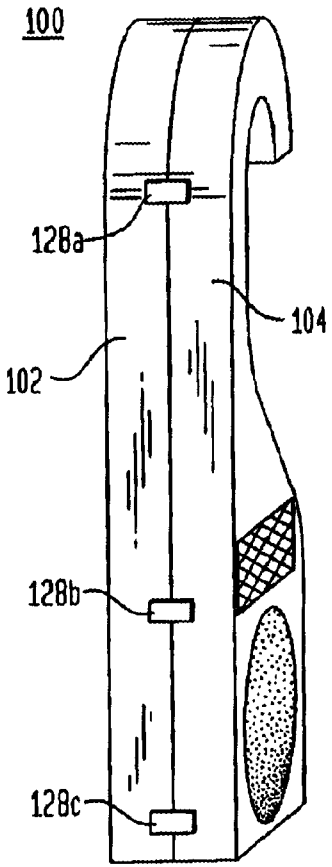
FIG. 1B is a perspective rear view of a smoke detector attached to an evacuation guide.
Figure 1A:
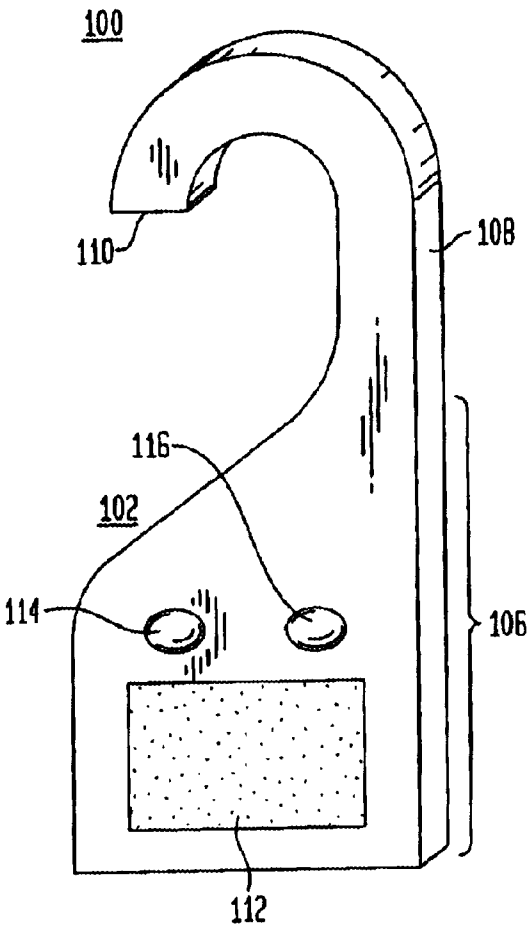
FIG. 1A is a perspective front view of a smoke detector.

Referring to the drawings, FIG. 1 shows a preferred embodiment of the emergency response system ("ERS") 100 of the present invention. The ERS 100 preferably includes a smoke detector 102 and an evacuation guide 104 for helping an occupant escape potential danger in a home or building. Both the smoke detector 102 and evacuation guide 104 preferably are portable, but both also may be positioned permanently at desired locations within a home or building.

The smoke detector 102 functions as a conventional smoke detector by detecting the presence of smoke in a home or building and emitting an alarm signal, either audible or visible, to warn occupants. Non-limiting examples of audible alarm signals include high-pitched tones or beeps and sirens. Non-limiting examples of visible alarm signals include flashing strobe lights, a spotlight illuminating an exit, and blinking overhead lights. The smoke detector 102 has a shape preferably formed from a body 106 and a neck 108 contiguous with and extending up and away from the body 106. The neck 108 preferably extends upward in the same vertical plane as the body 106. The neck 108 ends in a curved handle 110. The handle 110 is the preferred means for hanging the smoke detector 102. The shape of the smoke detector 102 makes it easily portable, and allows it to be installed and moved to various locations with minimal effort. One simply removes the smoke detector 102 from one door handle and hangs the smoke detector 102 via the handle 110 from another door handle near a desired location. Alternative means for hanging the smoke detector 102 include, but are not limited to, double sticky-hack tape, nails, tacks, glue, and hook and loop fasteners.

The body 106 of the smoke detector 102 includes a means for sensing smoke 112, a means for emitting an alarm signal, either audible or visible, an on/off button 114, and a test button 116. The means for sensing smoke 112 and the means for emitting an alarm signal, as well as the electronic components used to make the on/off button 114 and the test button 1 16, may be selected from components well known in the art and may be adapted by one skilled in the art in a manner consistent with the intended function and combination described herein without undue experimentation.

The body 106 of the smoke detector 102 preferably includes a means for generating an activation signal. Non-limiting examples of activation signals include infrared (IR) signals, ultrasound signals, inductive signals, electrostatic signals, or electromagnetic signals, such as HF, UHF, or VHF radio signals. The most preferred activation signals are those in the form of radio waves, and the most preferred means for generating the activation signal is a radio transmitter. The radio transmitter used in the body 106 of the smoke detector 102 may be selected from components well known in the art and may he adapted by one skilled in the art in a manner consistent with the intended function and combination described herein without undue experimentation.

The evacuation guide 104 has a shape preferably formed from a body 118 and a neck 120 contiguous with and extending up and away from body 118. The neck 120 preferably extends upward in the same vertical plane as the body 118. The neck 120 ends in a curved handle 122. The handle 122 is the preferred means for hanging the evacuation guide 104. The shape of the evacuation guide 104 makes it easily portable, and allows it to be installed and moved to various locations with minimal effort. One simply removes the evacuation guide 104 from one door handle and hangs the evacuation guide 104 via the handle 122 from another door handle near a desired location. In a preferred embodiment, the smoke detector 102 is hung on the knob outside the door to an occupant's bedroom, and the evacuation guide 104 is hung on the knob inside the same door. Alternative means for hanging the evacuation guide 104 include, but are not limited to, double sticky-back tape, nails, tacks, glue, and hook and loop fasteners. The neck 120 of the evacuation guide 104 has a length sufficiently long, and a diameter sufficiently small, that an occupant having small hands, such as a young child or elderly lady, easily can pick up and hold on to the evacuation guide 104 as he or she follows instructions transmitted therefrom and evacuates the home or building.

The body 118 of the evacuation guide 104 preferably includes a built-in flashlight 124, a means for receiving the activation signal which is generated by the smoke detector 102, and a means for delivering a message to an occupant in a home or a building. The activation signal preferably is received by a radio receiver housed in the body 118 of the evacuation guide 104. Upon receipt of the activation signal, the evacuation guide delivers a message to occupants of the home or building to help them evacuate the area. The message preferably is an audible message, but the message optionally may be a visible message delivered by means such as an LCD display. Non-limiting examples of the means for delivering a message include digital recording and playback devices 126, analog recording and playback devices, and LDC display, and a speaker through which another person can communicate to the occupants in real-time, e.g., similar to a walky-talky or two-way radio. The most preferred means for delivering a message is a recording and playback device 126. The digital recording and playback device 126, as well as the radio receiver, used in the evacuation guide 104 may be selected from components well known in the art and may be adapted by one skilled in the art in a manner consistent with the intended function and combination described herein without undue experimentation.

While the smoke detector 102 and evacuation guide 104 complement one another, each is a self-contained and separate unit from the other, and each is adapted to be used while physically detached from the other. In a preferred embodiment of the invention, the smoke detector 102 and the evacuation guide 104 each has a shape that is the mirror image of the shape of the other. As a result, the smoke detector 102 and evacuation guide 104 can be placed back-to-back when not in use and secured together using latches 128, clips, or other securing means known to one having skill in the art.

In operation, the ERS 100 preferably is used in conjunction with a door having door knobs on both sides, i.e., the inside and the outside. The ERS 100 is used to detect smoke in a home or other building by hanging the smoke detector 102 from the door outside a child's (or other occupant's) bedroom by placing the handle 110 of the smoke detector 102 around the door knob, The evacuation guide 104 preferably is similarly hung by handle 122 from the door knob inside the child's bedroom. The smoke detector 102 and evacuation guide 104 thus are portable and can be moved easily to various locations in a home or building.

The smoke detector 102 emits an alarm, either audibly or visually, to warn occupants of the presence of smoke. In addition to emitting an alarm, the radio transmitter in the smoke detector 102 generates an activation signal in the form of radio waves. The activation signal is received by a radio receiver within the evacuation guide 104. Upon receipt of the activation signal, the evacuation guide 104 preferably begins delivering, via a digital recording and playback device 126, a message to occupants in the home or building. The message may contain various information including but not limited to the most direct route to evacuate the home or building, emergency phone numbers, the location of the nearest exit, or the location of the nearest fire extinguisher. Alternatively, the evacuation guide can house a speaker through which other individuals having a microphone or other means for communicating can deliver a real-time message to the occupants with the evacuation guide 104. Also, upon receipt of the activation signal, a flashlight 122 housed in the evacuation guide preferably is illuminated, thereby providing an immediate and proximate light source to the occupants as they evacuate a building.

CONCLUSION

While various embodiments of the present invention have been described above, it should be under-stood that they have been presented by way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined only in accordance with the following claims and their equivalents.

What is claimed is:

1. An emergency response system, comprising:

a smoke detector having a front, a back, a shape, a body, a neck contiguous with and extending from said body and ending in a curved handle, and a means for generating an activation signal; and an evacuation guide having a front, a back, a shape, a body, a neck contiguous with and extending from said body and ending in a curved handle, a means for receiving said activation signal, and a means for delivering a message to an occupant of a home or a building;

wherein said smoke detector is a self-contained and separate unit from said evacuation guide and is adapted to be used while physically detached from said evacuation guide, and further wherein said evacuation guide is a self-contained and separate unit from said smoke detector and is adapted to be used while physically detached from said smoke detector.

2. The emergency response system of claim 1, wherein said evacuation guide further comprises a built-in flashlight.

3. The emergency response system of claim 1, wherein the shape of said evacuation guide is a mirror image of the shape of said smoke detector.

4. The emergency response system of claim 3, wherein said smoke detector further comprises a means for securing said evacuation guide in a back-to-back physical relationship with said smoke detector.

5. The emergency response system of claim 4, wherein said means for securing is a series of latches.

6. The emergency response system of claim 1, wherein said evacuation guide is detachably connected to said smoke detector.

7. The emergency response system of claim 1, wherein said activation signal is selected from the group consisting of infrared signals, ultrasound signals, inductive signals, electrostatic signals, and electromagnetic signals including HF, UHF, and VHF radio signals.

8. The emergency response system of claim 1, wherein said means for generating an activation signal is a radio transmitter.

9. The emergency response system of claim 1, wherein said means for receiving said activation signal is a radio receiver.

10. The emergency response system of claim 1, wherein said means for delivering a message to an occupant of a home or a building is selected from the group consisting of a digital recording and playback device, an analog recording and playback device, and a speaker and microphone.

11. The emergency response system of claim 1, wherein said smoke detector emits an audible warning when smoke is detected.

12. The emergency response system of claim 11, wherein said audible warning is a series of high-pitched tones.

13. The emergency response system of claim 1, wherein said smoke detector emits a visible warning when smoke is detected.

14. The emergency response system of claim 13, wherein said visible warning is a blinking strobe light.

15. A method of operating an emergency response system in an environment having a room with a door having an inside door knob and an outside door knob, comprising the steps of:

(a) detecting smoke using a smoke detector, said smoke detector having a shape, a body, a neck contiguous with and extending from said body and ending in a curved handle, and a means for generating an activation signal, by hanging said handle of said smoke detector on the outside door knob.

(b) generating said activation signal from said smoke detector upon detection of smoke;

(c) receiving said activation signal by an evacuation guide, said activation guide having a shape, a body, a neck contiguous with and extending from said body and ending in a curved handle, a means for receiving said activation signal, and a means for delivering a message to an occupant of a home or a building; said evacuation guide being hung from the inside door knob by said handle;

(d) delivering a message to the occupant inside the room.

16. The method of claim 15, wherein said evacuation guide further comprises a built-in flashlight.

17. The method of claim 16, further comprising the step of:

(e) illuminating said flashlight.

18. The method of claim 15, wherein said message is audible.

19. The method of claim 15, wherein said message is visible.

20. The method of claim 18, wherein said message is delivered by a digital playback device, an analog playback device, or a speaker connected to a microphone.

* * * * *